US011519151B2

(12) United States Patent
Taylor

(10) Patent No.: US 11,519,151 B2
(45) Date of Patent: Dec. 6, 2022

(54) CONNECTOR FOR SOIL REINFORCING AND METHOD OF MANUFACTURING

(71) Applicant: The Taylor IP Group LLC, Colleyville, TX (US)

(72) Inventor: Thomas P. Taylor, Colleyville, TX (US)

(73) Assignee: THE TAYLOR IP GROUP LLC, Colleyville, TX (US)

( * ) Notice: Subject to any disclaimer, the term of this patent is extended or adjusted under 35 U.S.C. 154(b) by 0 days.

(21) Appl. No.: 17/238,712

(22) Filed: Apr. 23, 2021

(65) Prior Publication Data

US 2021/0340718 A1 Nov. 4, 2021

Related U.S. Application Data

(60) Provisional application No. 63/014,287, filed on Apr. 23, 2020.

(51) Int. Cl.
*E02D 29/02* (2006.01)

(52) U.S. Cl.
CPC ..... *E02D 29/0233* (2013.01); *E02D 2250/00* (2013.01); *E02D 2300/0006* (2013.01); *E02D 2300/0034* (2013.01); *E02D 2600/30* (2013.01)

(58) Field of Classification Search
CPC . E02D 29/02; E02D 29/0225; E02D 29/0233; E02D 29/0241
USPC ..... 405/262, 284–286
See application file for complete search history.

(56) References Cited

U.S. PATENT DOCUMENTS

| | | | | |
|---|---|---|---|---|
| 5,484,235 | A | 1/1996 | Hilfiker | |
| 5,702,208 | A | 12/1997 | Hilfiker | |
| 5,733,072 | A * | 3/1998 | Hilfiker | E02D 29/0241 405/262 |
| 5,749,680 | A | 5/1998 | Taylor | |
| 5,807,030 | A * | 9/1998 | Anderson | E02D 29/0241 405/262 |
| 5,820,305 | A | 10/1998 | Taylor | |
| 5,975,809 | A | 11/1999 | Taylor | |
| 5,975,810 | A | 11/1999 | Taylor | |
| 6,024,516 | A | 2/2000 | Taylor | |
| 6,517,293 | B2 | 2/2003 | Taylor | |
| D599,630 | S | 9/2009 | Taylor | |
| 7,722,296 | B1 | 5/2010 | Taylor | |

(Continued)

FOREIGN PATENT DOCUMENTS

| | | | |
|---|---|---|---|
| FR | 2973401 A1 * | 10/2012 | |
| WO | WO9604430 A1 * | 2/1996 | |

(Continued)

OTHER PUBLICATIONS

WO2021/217015, International Search Report and Written Opinion, dated Aug. 10, 2021, 12 pages—English.

(Continued)

*Primary Examiner* — Sunil Singh
(74) *Attorney, Agent, or Firm* — Andrew F. Young; Nolte Lackenbach Siegel

(57) ABSTRACT

An apparatus, system and method of connecting an earthen formation to a facing of a mechanically stabilized earth (MSE) structure in which a connector includes a single piece of wire that defines an opening for coupling the connector to an anchor and a pair parallel legs for mechanically connecting the to a soil reinforcing element.

14 Claims, 6 Drawing Sheets

(56) References Cited

U.S. PATENT DOCUMENTS

| | | | | |
|---|---|---|---|---|
| 7,891,912 | B2 | 2/2011 | Taylor | |
| 7,972,086 | B2 | 7/2011 | Taylor | |
| 7,980,790 | B2 | 7/2011 | Taylor | |
| 8,177,458 | B2 | 5/2012 | Taylor | |
| 8,393,829 | B2 | 3/2013 | Taylor | |
| 8,496,411 | B2 | 7/2013 | Taylor | |
| 8,632,277 | B2 | 1/2014 | Taylor | |
| 8,632,278 | B2 | 1/2014 | Taylor | |
| 8,632,279 | B2 | 1/2014 | Taylor | |
| 8,632,280 | B2 | 1/2014 | Taylor | |
| 8,632,281 | B2 | 1/2014 | Taylor | |
| 8,632,282 | B2 | 1/2014 | Taylor | |
| 8,734,059 | B2 | 5/2014 | Taylor | |
| 9,267,259 | B2 | 2/2016 | Taylor | |
| 9,605,402 | B2 | 3/2017 | Taylor | |
| 2002/0044841 | A1* | 4/2002 | Taylor | E02D 29/0241 405/259.1 |
| 2005/0111921 | A1 | 5/2005 | Taylor | |
| 2010/0247248 | A1* | 9/2010 | Taylor | E02D 5/76 405/262 |
| 2011/0170958 | A1 | 7/2011 | Taylor | |
| 2013/0114430 | A1 | 5/2013 | Koivisto et al. | |
| 2013/0133174 | A1 | 5/2013 | Taylor | |
| 2014/0093318 | A1 | 4/2014 | Taylor | |
| 2015/0132069 | A1 | 5/2015 | Taylor | |
| 2015/0132070 | A1 | 5/2015 | Taylor | |
| 2021/0332549 | A1 | 10/2021 | Taylor | |
| 2021/0340718 | A1 | 11/2021 | Taylor | |

FOREIGN PATENT DOCUMENTS

| | | | |
|---|---|---|---|
| WO | WO2009/140576 | | 11/2009 |
| WO | WO2010/082940 | | 7/2010 |
| WO | WO2009/009369 | | 12/2010 |
| WO | WO2010/141529 | | 12/2010 |
| WO | WO 2010141529 | A1 * | 12/2010 |
| WO | WO2011/084983 | | 7/2011 |
| WO | WO2011/084986 | | 7/2011 |
| WO | WO2011/084989 | | 7/2011 |
| WO | WO2011/127349 | | 10/2011 |
| WO | WO2011/159807 | | 12/2011 |
| WO | WO/2011/159808 | | 12/2011 |
| WO | WO2011/159809 | | 12/2011 |
| WO | WO2012/102980 | | 8/2012 |
| WO | WO2012/151342 | | 11/2012 |
| WO | WO2013/081989 | | 6/2013 |
| WO | WO2021/217022 | | 10/2021 |
| WO | WO2022/051686 | | 3/2022 |

OTHER PUBLICATIONS

WO2021/217022, International Search Report and Written Opinion, dated Aug. 10, 2021, 10 pages—English.

WO2022/051686 International Search Report and Written Opinion, dated Dec. 1, 2021, 9 pages—English.

* cited by examiner

CONNECTOR FOR SOIL REINFORCING AND METHOD OF MANUFACTURING

CROSS REFERENCE TO RELATED APPLICATIONS

The present application claims priority to and the benefit of U.S. Prov. Pat. App. Ser. No. 63/014,287, which was filed on Apr. 23, 2020, which to the extent that it is consistent with the present disclosure is hereby incorporated herein by reference in its entirety and to the extent that is not inconsistent with the present disclosure.

BACKGROUND

Technical Field

The invention relates to a connector or connection element that is mechanically attached to soil reinforcing that is used in mechanically stabilized earth structures.

Description of the Related Art

Earth retaining structures that are constructed using substantially horizontally positioned soil inclusions in combination with compacted backfill are referred to as mechanically stabilized earth (MSE) structures. MSE structures are known to be used for retaining wall systems, earthen embankments, to support bridge structures as abutments, to retain water in dams, among others.

MSE construction consists of placing compacted backfill and soil reinforcing in at regular thicknesses until a desired height of the structure is reached. The soil reinforcing elements are spaced horizontally and vertically at regular intervals. It is known that the soil reinforcing elements can consist of metal or plastic that may be strips, continuous sheets or grids. The soil reinforcing elements are known to fabricated to form planar and bi-planer elements that contain different surface configurations, patterns, and protrusions along their length. The soil reinforcing elements are generally placed perpendicular to the face of the embankment however may be placed in other directions to bypass obstructions. For noncontinuous soil reinforcing systems the adjacent elements are spaced apart and are in the same plane. The soil reinforcing in combination with the compacted backfill forms a composite structure that behaves similar to reinforced concrete elements. The compacted backfill supports compressive forces and the soil reinforcing supports tensile forces.

In some instances, the soil reinforcing elements are attached to facing element that forms the outer surface of the MSE structure. The facing elements can be vertical or battered and can be formed from concrete, wire, wood, steel, or other like material. The facing prevents erosion of the backfill between successive rows and columns of the soil reinforcing and also serves as a decorative veneer. The proximal ends of the soil reinforcing elements are attached to the facing in many different ways.

A retaining wall soil reinforcing connector and method, is shown and described in U.S. Pat. No. 8,632,277, which shares inventorship with the present application and is commonly owned, is fully incorporated herein by reference.

Referring to FIG. 1A-1C, an exemplary system 100 for securing a facing 102 to an earthen formation or backfill 104 mass, according to one or more aspects of the disclosure. The facing 102 may include an individual precast concrete panel or, alternatively, a plurality of interlocking precast concrete modules or wall members that are assembled into an interlocking relationship. In another embodiment, the facing 102 may be a uniform, unbroken expanse of concrete or the like which may be poured or assembled into an interlocking relationship. In another embodiment, the facing 102 may be a uniform, unbroken expanse of concrete or the like which may be poured or assembled on site. The facing 102 may generally define an exposed face 105 (FIGS. 1B and 1C) and a back face 106. The exposed face 105 typically includes a decorative architectural facing, while the back face 106 is located adjacent to the backfill 104. Cast into the facing 102, or otherwise attached thereto, and protruding generally from the back face 106, is at least one exemplary anchor 108. Instead of being cast into the facing 102, the facing anchor 108 may be mechanically fastened to the back face 106, for example, using bolts (not shown). As will be described below, several variations of the facing anchor 108 may be implemented without departing from the scope of the disclosure.

The earthen formation or backfill 104 may encompass an MSE structure including a plurality of soil reinforcing elements 110 that extend horizontally into the backfill 104 to add tensile capacity thereto. In an exemplary embodiment, the soil reinforcing elements 110 may serve as tensile resisting elements positioned in the backfill 104 in a substantially horizontal alignment at spaced-apart relationships to one another against the compacted soil. Depending on the application, grid-like steel mats or welded wire mesh may be used as soil reinforcement elements 110, but it is not uncommon to employ "geogrids" made of plastic or other materials to accomplish the same end.

The earthen formation or backfill 104 may encompass an MSE structure including a plurality of soil reinforcing elements 110 that extend horizontally into the backfill 104 to add tensile capacity thereto. In an exemplary embodiment, the soil reinforcing elements 110 may serve as tensile resisting elements positioned in the backfill 104 in a substantially horizontal alignment at spaced-apart relationships to one another against the compacted soil. Depending on the application, grid-like steel mats or welded wire mesh may be used as soil reinforcement elements 110, but it is not uncommon to employ "geogrids" made of plastic or other materials to accomplish the same end.

In the illustrated exemplary embodiment, the soil reinforcing element 110 may include a welded wire grid having a pair of longitudinal wires 112 that are substantially parallel to each other. The longitudinal wires 112 may be joined to a plurality of transverse wires 114 in a generally perpendicular fashion by welds at their intersections, thus forming a welded wire gridworks. In exemplary embodiments, the spacing between each longitudinal wire 112 may be about 2 in., while spacing between each transverse wire 114 may be about 6 in. As can be appreciated, however, the spacing and configuration may vary depending on the mixture of tensile force requirements that the reinforcing element 110 must resist.

In one or more embodiments, lead ends 116 of the longitudinal wires 112 may generally converge toward one another and be welded or otherwise attached to a connection stud 118 of a connector 10 that includes a tab or plate 122 extending from the connection stud 118. The connection stud 118 may include a first end or a stem 120 coupled or otherwise attached to a second end or a tab 122. As will be described below, several variations of the connection stud 118 may be implemented, without departing from the disclosure. In at least one embodiment, the stem 120 may include a cylindrical body having an axial length L. As illustrated, the lead ends 116 may be coupled or otherwise attached to the stem 120 along at least a portion of the axial length L. In one embodiment, the tab 122 may be a substantially planar plate and define at least one centrally-located perforation or hole 124.

In at least one embodiment, the facing anchor 108 may include a pair of horizontally-disposed connection points or plates 126 *a*, 126 *b* cast into and extending from the back face 106 of the panel 102. As can be appreciated, other embodiments include attaching the facing anchor directly to the back face 106, without departing from the disclosure. Furthermore, as can be appreciated, other embodiments of the disclosure contemplate a facing anchor 108 having a single horizontal plate 126 (not shown), where the tab 122 is coupled only to the single plate 126 via appropriate coupling devices.

Each plate 126 *a, b* may include at least one perforation 128 adapted to align with a corresponding perforation 128 on the opposing plate 126 *a,b*. As illustrated in FIG. 1B, the plates 126,*b* may be vertically-offset a distance X, thereby generating a gap 132 configured to receive the tab 122 for connection to the anchor 108. In operation, the tab 122 may be inserted into the gap 132 until the hole 124 aligns substantially with the perforations 128 of each plate 126 *a, b*. A coupling device, such as a nut and bolt assembly 130 or the like, may then be used to secure the connection stud 118 (and thus the soil reinforcing element 110) to the facing anchor 108. In one or more embodiments, the nut and bolt assembly 130 may include a threaded bolt having a nut and washer assembly, but can also include a pin-type connection having an end that prevents it from removal, such as a bent-over portion.

In this arrangement, the soil reinforcing element 110 (as coupled to the connection stud 118) may be allowed to swivel or rotate about axis Y in a horizontal plane Z (FIG. 1A). Rotation about axis Y may prove advantageous since it allows the system 100 to be employed in locations where a vertical obstruction, such as a drainage pipe, catch basin, bridge pile, bridge pier, or the like may be encountered in the backfill 104. To avoid such obstructions, the soil reinforcing element 110 may be pivoted about axis Y to any angle relative to the back face 106, thereby swiveling to a position where no obstacle exists.

Moreover, the gap 132 defined between two vertically-offset plates 126*a*, 126*b* may also prove significantly advantageous. For example, the gap 132 may compensate or allow for the settling of the MSE structure as the soil reinforcing element 110 settles in the backfill 104. During settling, the tab 122 may be able to shift or slide vertically about the nut and bolt assembly 130 the distance X, thereby compensating for a potential vertical drop of the soil reinforcing element 110 and preventing any buckling of the concrete facing 102. As will be appreciated by those skilled in the art, varying designs of anchors 108 may be used that increase or decrease the distance X to compensate for potential settling or other MSE mechanical phenomena.

Furthermore, it is not uncommon for concrete facings 102 to shift in reaction to MSE settling or thermal expansion/contraction. In instances where such movement occurs, the soil reinforcing elements 110, which include longitudinal wires 112, of the disclosure are capable of correspondingly swiveling about axis Y and shifting the vertical distance X to prevent misalignment, buckling, or damage to the concrete facing 102.

As described above, the connector 10, which couples the reinforming element 110 (e.g., wires) to the anchor 108, includes the stem 120 that is coupled to a tab 122 that includes a hole 124 for receiving a fastener (e.g., the bolt of the nut and bolt assembly 130) therethrough and through perforations 128 defined in vertically-offset plates 126*a*, 126*b* of the anchor 108. Various other kinds of connectors are illustrated in FIGS. 2A-2D. For example, as shown in FIG. 2A, a connector 5 may be a plate, which may have a rectangular configuration, that is welded (e.g., resistive welded) to the longitudinal wires 112. A hole is formed within the plate of the connector 5 to receive a fastener (not shown) therethrough. FIG. 2B, illustrates another connector 10, which includes a stem that is welded to the longitudinal wires 112 and tab through which a hole is formed to receive a fastener, similar to the connector that is described above with respect to FIGS. 1A-1C.

It should be understood that the background is provided to aid in an understanding of the present disclosure and that nothing in the background section shall be construed as an admission of prior art in relation to the inventions described herein.

SUMMARY

In an embodiment, a connection element for a mechanically stabilized earth structure may include a first longitudinal wire that includes a proximal end and a second longitudinal wire that includes a proximal end. The connection element may include a pair of legs that are biased apart from one another, each of the pair of legs configured to be coupled to respective ones of the proximal end of the first longitudinal wire and the proximal end of the second longitudinal wire, the pair of legs being biased apart from one another; and a fastener receptacle. The connection element may have a unitary construction and may be formed from a single length of wire. The single length of wire may have a round, square, rectangular, hexagonal, or octagonal cross-section, or any combination thereof, but is not limited thereto. The pair of legs may include a first leg and a second leg, the first leg including a first elongated longitudinally extending section, the second leg including a second elongated longitudinally extending section, the first elongated longitudinally extending section being parallel to the second elongated longitudinally extending section. The first leg may include a first section extending longitudinally to a distal end and a second section that orthogonally extends from the distal end of the first section; and the second leg may include a first section extending longitudinally to a distal end and a second section that orthogonally extends from the distal end of the second section. The single length of wire may be bent a number of degrees about an axis extending orthogonally relative to a lengthwise axis of the single piece of wire to form a coiled section that defines the fastener receptacle. The number of degrees may equal 180 degrees, 270 degrees, or 540 degrees, but may also have a greater or lesser number degrees corresponding to, for example, complete or half revolutions relative to the axis about which the wire is bent.

In another embodiment, a system for securing a facing of an earthen formation may include the above-described connection element and may also include a facing anchor. The facing anchor may be hingedly connected to the connection element via a fastener extending through the fastener receptacle of the connection element.

In yet another embodiment, a method of manufacturing a soil reinforcing connection element assembly may include: bending a connection element consisting of a single wire into a configuration with a central opening and two legs at the distal ends that are substantially parallel; providing a soil reinforcing element with a proximal end and a terminal end consisting of at least two longitudinal members and cross members; and/or mechanically joining the connection element distal ends to the proximal ends of the soil reinforcing element.

These and other aspects of the present disclosure are described in greater detail below with reference to the accompanying figures.

DETAILED DESCRIPTION

Various embodiments and aspects of the present disclosure will be described with reference to the accompanying drawings in which like or similar features are labeled with the same reference number. The following description and drawings are illustrative of the present disclosure and are not to be construed as limiting the disclosure. Numerous specific details are described to provide a thorough understanding of various embodiments of the present disclosure. However, well-known or conventional details are not described in order to provide a concise discussion of embodiments of the present disclosure.

Figure 2A:
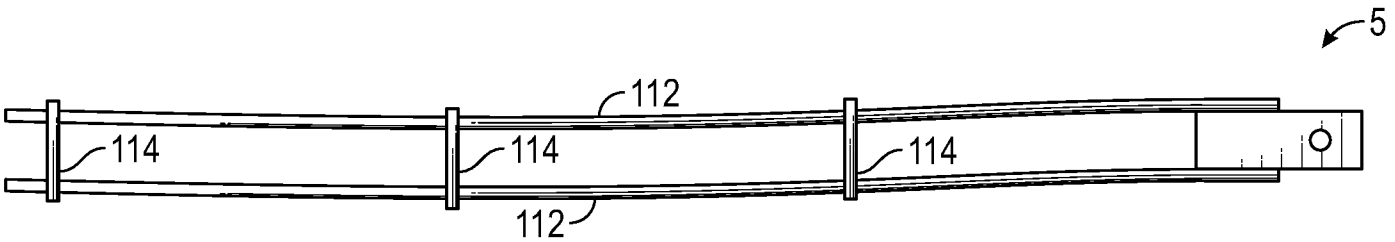
FIG. 2A (Prior Art)
FIG. 2A is a plan view of a proximal end connector plate shown coupled to longitudinally extending soil reinforcing wires according to the prior art.
Figure 2B:
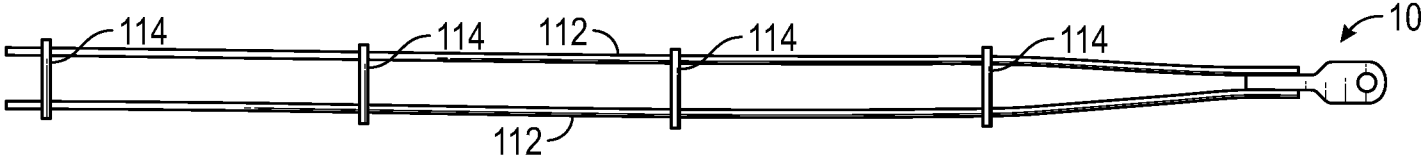
FIG. 2B (Prior Art)
FIG. 2B is a plan view of a proximal end connector plate shown coupled to longitudinally extending soil reinforcing wires according to the prior art.

The present disclosure presents a connector that is advantageous over such prior art connectors as are described above for a variety of reasons including more efficient use of material and time as a unitary length of wire may be configured in a greater variety of sizes and can be coupled to the MSE faster and more cheaply. For example, in FIG. 2B, the connector 10 includes a stem that is narrower than the spacing between longitudinal wires 112 such that welding the longitudinal wires 112 to the stem of the connector 10 would require compressing the longitudinal wires 112 toward one another and in contact with the stem of the connector 10, which would increase the time required for installation. In contrast, the connector 5 has a rectangular shape and may be pre-formed to correspond to the spacing of the longitudinal wires 112. The connector 5 would necessarily require more material than the connector 10, and for both of the connectors 5, 10, a hole would have to be drilled through the material for a receptacle for securing the connectors 5, 10 to an anchor. The connectors known in the art that utilize a plate, e.g., connector 5, are known to be attached to soil reinforcing elements with longitudinal wires that are spaced at two inches. The narrow plate controls the cost of the system it is therefore advantageous to have as narrow as plate as possible. Most welding fabrication machines are not constructed to weld a narrow element, such as the two-inch element. Because of this the number of fabricators diminishes and the need for a specialized welded wire machines increase.

The present disclosure provides a connector that is advantageous over the connectors 5, 10 in that it uses material efficiently and can be configured in a variety of sizes such that there is a greater number of options for spacing between the longitudinal wires 112. For example, it may be preferable to have a relatively narrow spacing between the wires such that the MSE structure is relatively rigid. The present disclosure provides for a greater variety of configurations of the connector while using materials efficiently and not necessitating any change in the manufacturing process. Conventionally, the connectors 5, 10, in contrast may only be readily available in certain sizes as it would be inefficient for a factory to make a great variety of connectors having different sizes.

The present disclosure provides various embodiments of a one-piece MSE connector that facilitate soil reinforcing with a variety of longitudinal wire spacings to be connected to a variant of the connector without an increase in the component cost. Another advantage of the connector is that it is a single point connector that allows soil reinforcing to swivel in order to avoid vertically-disposed obstructions, such as drainage pipes, catch basins, bridge piles, or bridge piers, which may be encountered in the adjacent compacted backfill. Still another advantage of the connector is it can be attached to varying width soil reinforcing elements providing a distinct advantage that allows the system to be attached to welded wire fabricated on almost any automated mesh welder by most welded wire suppliers.

Figure 1A:
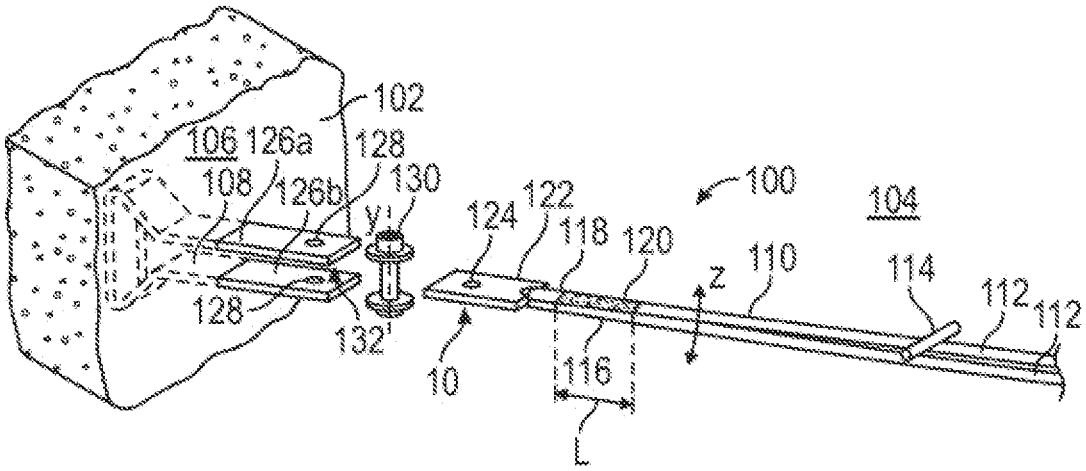
FIG. 1 A (Prior Art)
FIG. 1A is an exploded perspective view of a prior art soil reinforcing system.
Figure 1B:
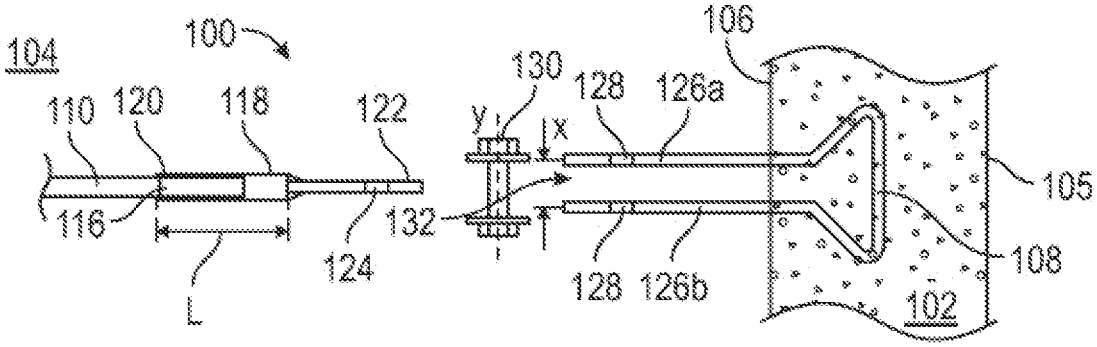
FIG. 1B (Prior Art)
FIG. 1B is a side view of the system shown in FIG. 1A.
Figure 1C:
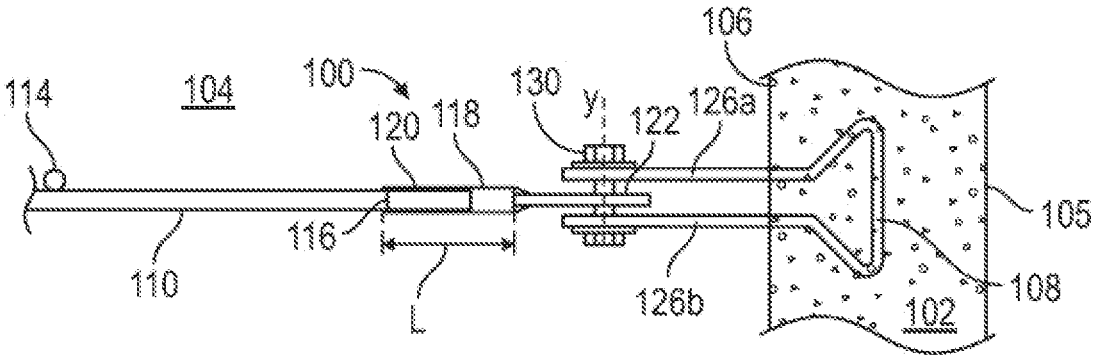
FIG. 1C (Prior Art)
FIG. 1C is a side view of the system shown in FIG. 1A coupled together.
Figure 3:
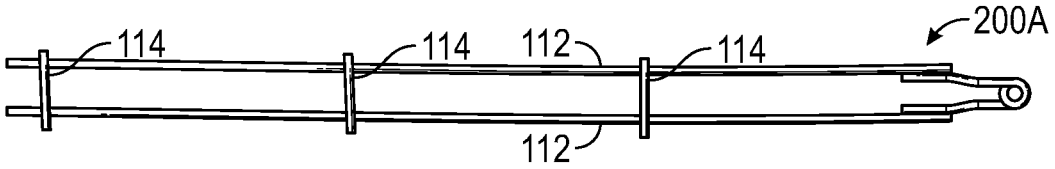
FIG. 3 is a plan view of an embodiment of a single wire connector shown coupled to longitudinally extending soil reinforcing wires according to the present disclosure.
Figure 4:
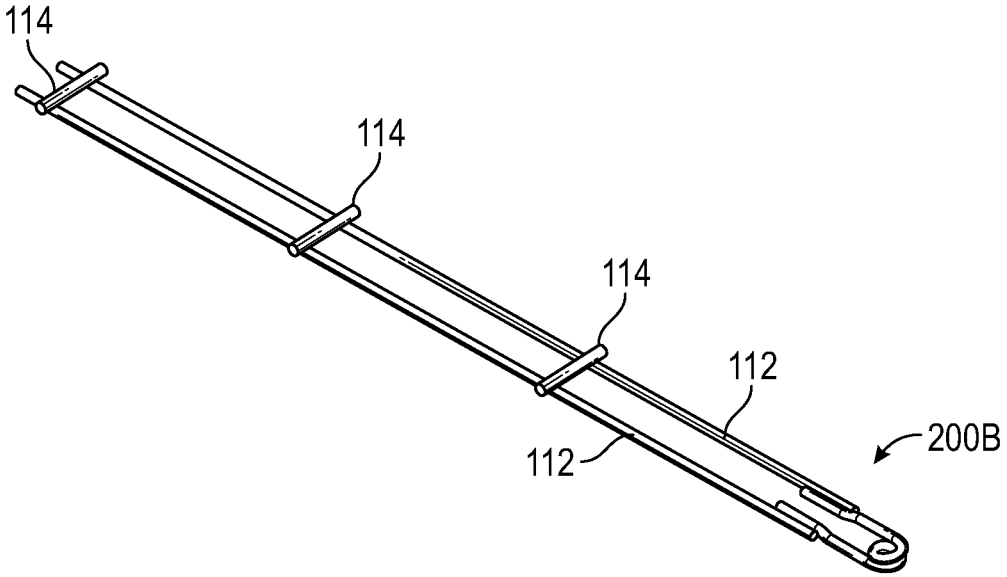
FIG. 4 is a perspective view of another embodiment of a single wire connector shown coupled to longitudinally extending soil reinforcing wires according to the present disclosure.
Figure 5:
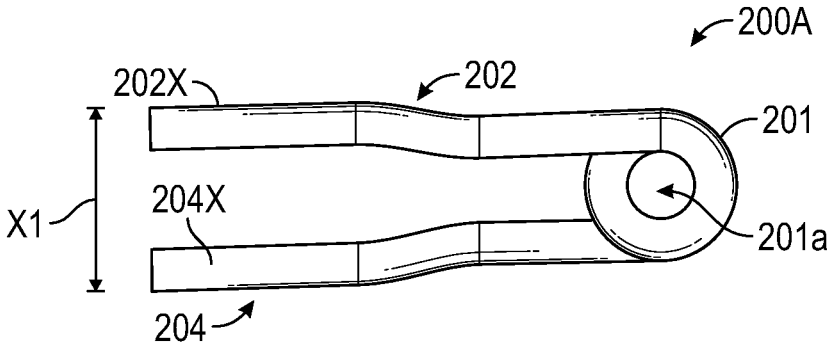
FIG. 5 is a plan view of a further embodiment of a single wire connector of FIG. 3.

In accordance with an embodiment of the present disclosure, a connector 200A that may be used instead of the connectors 5, 10 (FIGS. 1-2B) is now described with reference to FIGS. 3-5.

The connector 200A may have a unitary construction and may be formed from a single length of wire. As used herein, the term "unitary" means formed of a single piece, e.g., a single length of wire. The wire may be formed of a material including a metal material, such as, stainless steel or other metals or metal alloys. The cross section of the wire for the connector can be round, square, rectangular, hexagonal, octagonal, or a combination thereof. The modification of the terminal end profile allows for an increase in area to apply different types of mechanical attachment processes such as metal added welding, or resistance welding.

The connector 200A may include a first leg 202 and a second leg 204. Distal sections 202*x*, 204*x* of respective ones of the first and second legs 202, 204 may be substantially parallel to one another and may be spaced apart by a distance X1 at the distal end D of the connector 200A, which may be greater than the width of the connector 200A at the proximal end P. The connector 200A may include a receptacle 201, at a proximal section of the connector 200A. The receptacle 201 may define an opening 201*a* through which a fastener, e.g., a bolt, may be received to secure the connector 200A to an anchor (e.g., anchor 108). The first and second legs 202, 204 may be secured to respective longitudinal wires 112, e.g., via resistive welding, which is advantageous such that there is no added metal in forming the weld.

Figure 6:
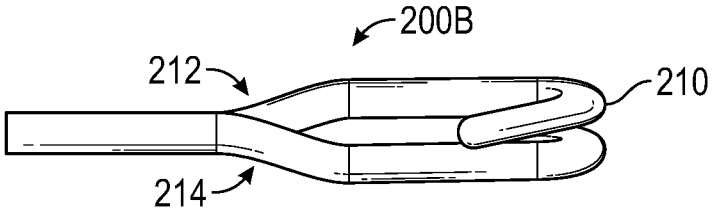
FIG. 6 is a side view of a still further embodiment of a single wire connector according to the present disclosure.
Figure 7:
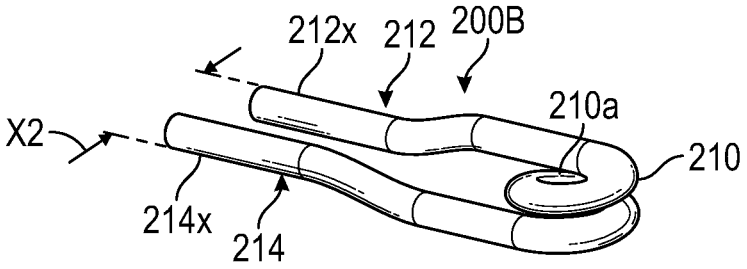
FIG. 7 is a perspective view of the single wire connector of FIG. 6.

As shown in FIGS. 6-7, a connector 200B is substantially similar except that the distal end defines a narrower width or space X2 between leg sections 212*x*, 214*x* of the first and second legs 212, 214 relative to its proximal end. The connector 200B is similarly formed in other respects and also includes a receptacle 210 defining an opening 210*a*.

Figure 8:
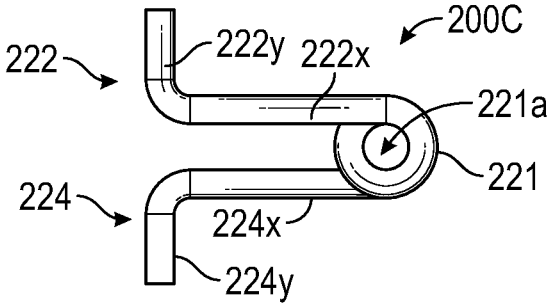
FIG. 8 is a plan view of the single wire connector of FIG. 6.

Another embodiment of a connector 200C will now be described with reference to FIG. 8. Similarly to the connectors 200A and 200B, the connector 200C includes a receptacle 221 that defines an opening 221*a* therethrough. The receptacle 221 is similar to the receptacles 201 and 210 of the connectors 200A and 200B, respectively. The connector 200C may include a pair of substantially parallel sections 222*x*, 224*x* extending from the receptacle 221. At distal ends of each of the sections 222*x*, 224*x*, sections 222*y*, 224*y* may extend substantially orthogonally from each of the sections 222*x*, 224*x*.

Figure 9:
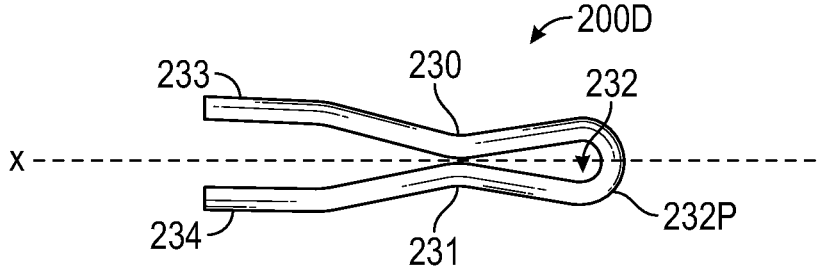
FIG. 9 is a plan view of another embodiment of a single wire connector.

As shown in FIG. 9, another embodiment of a connector 200D may include a single length of wire that is bent symmetrically about an axis x-x centrally extending along a length of the connector 200D. A first point 230 of the wire may be bent toward a second point 231 of the wire to form a substantially closed proximal section that defines a receptacle 232P having an opening 232, and an open section that includes a pair of two substantially parallel, distal sections 233, 234 which may be welded or otherwise secured to the longitudinal wires 112 of the MSE.

Figure 10A:
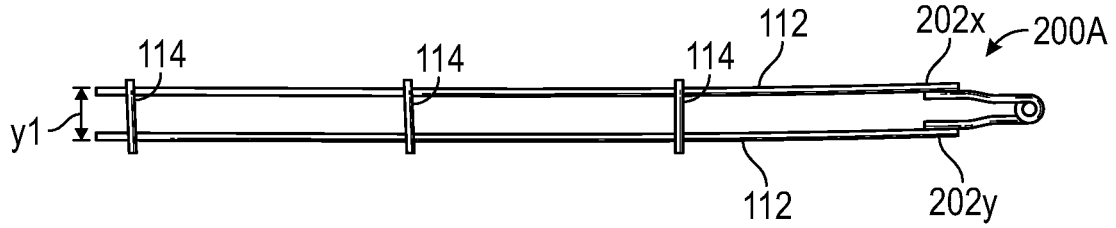
FIGS. 10A-10C depict the single wire connector of FIG. 3 having legs spaced apart by different widths from one another and coupled to longitudinally extending soil reinforcing wires.
Figure 10B:
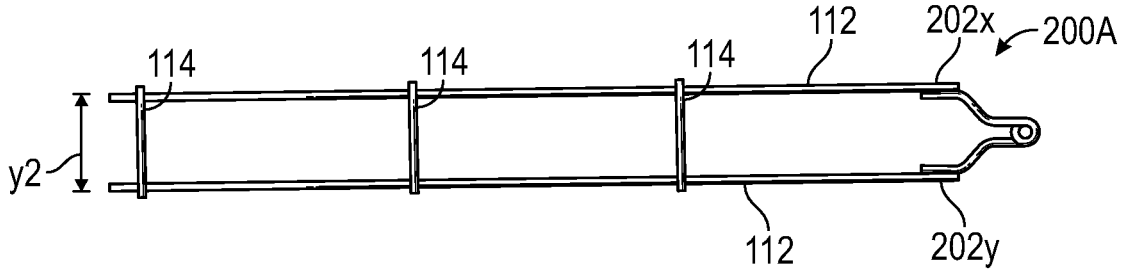
Figure 10C:
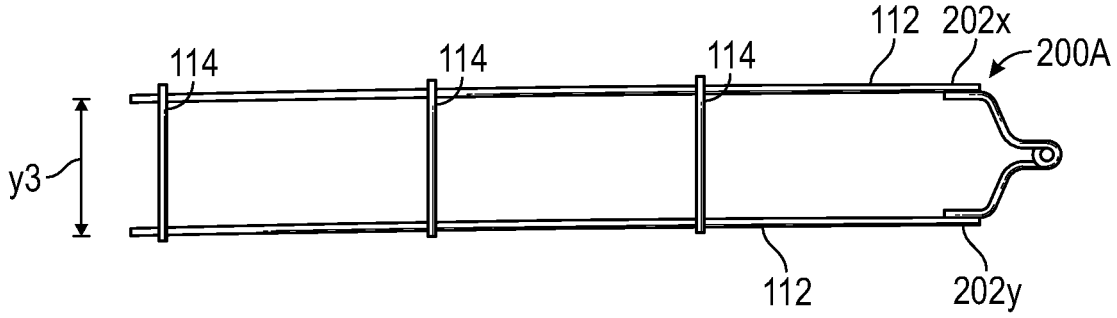

The connectors 200A-200D may be configured and/or adjusted to have varying dimensions by bending the wire forming the connector in different ways. As shown in FIGS. 10A-10C, the connector 200A is bent in such that the distal sections 202*x*, 204*x* of respective first and second legs 202, 204 are spaced apart by different widths Y1 (FIG. 10A), Y2 (FIG. 10B), and Y3 (FIG. 10C) corresponding to the spacing of the longitudinal wires 112 apart from one another to which the connector is be coupled (e.g., resistive welded).

Figure 11:
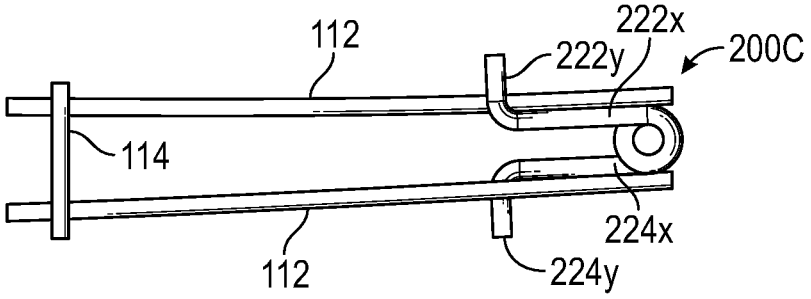
FIG. 11 is a plan view of the connector of FIG. 8 shown coupled to longitudinally extending soil reinforcing wires.

As shown in FIG. 11, the connector 200C provides multiple points for securing (e.g., welding) the connector to the longitudinal wires 112. The sections 222*x* and 224*x* may be welded along substantially their entire lengths to respective ones of the longitudinal wires 112 and the orthogonally extending sections 224*y*, 224*y* may facilitate stabilizing the connector 200C relative to the longitudinal wires 112 when welding the connector 200C to the longitudinal wires 112.

Figure 12:
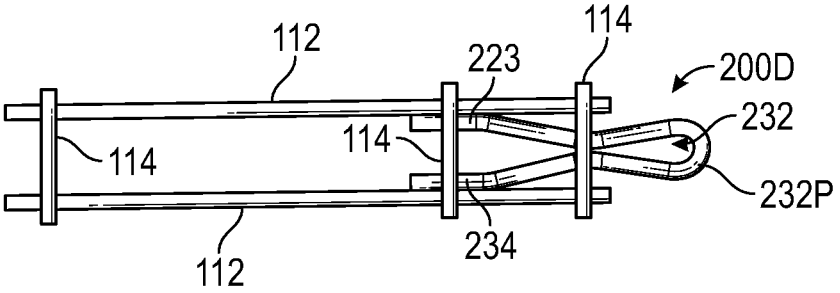
FIG. 12 is a plan view of the connector of FIG. 9 shown coupled to longitudinally extending soil reinforcing wires.

As shown in FIG. 12, the connector 200D may be secured to the longitudinal wires 112 by securing the distal sections 233, 234 of the legs to respective ones of the longitudinal wires 112. The distal sections 233, 234 may also be secured to the transverse wire 114, and the area in which the first and second points 230, 231 are drawn together to form a distal end of the opening 232 may be secured to another transverse wire 114 to stabilize the connector 200D relative to the longitudinal wires 112.

Figure 13:
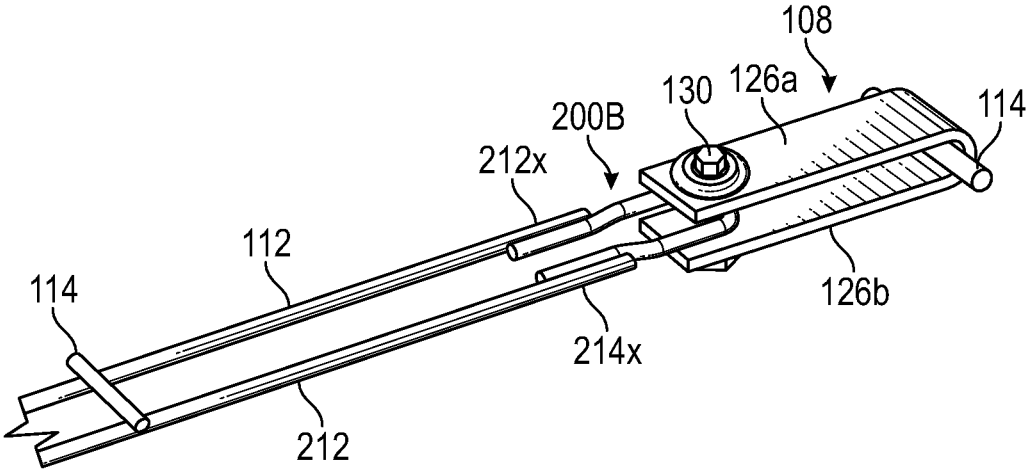
FIG. 13 Is a perspective view of the single wire connector of FIG. 4 shown coupled to longitudinally extending soil reinforcing wires and coupled to a connection place.

FIG. 13 illustrates the connector 200B being coupled to the anchor 108 via fastener such as the bolt of the nut and bolt assembly 130. Any of the connectors 200A, 200C, 200D may be similarly connected or coupled to the anchor 108. When one of the connectors 200A-200D is coupled to the anchor 108, the connector may be hingedly coupled to the anchor 108 such that the combined connection allows the soil reinforcing element to swivel in a horizontal plane.

A method of manufacturing the connectors 200A, 200B may include: providing a length of wire, which may be a metal (e.g., stainless steel); and bending the wire into a shape defining a central opening 201*a* at a proximal end and including two substantially parallel longitudinally extending distal sections 202*x*, 204*x* at a distal end thereof. Preferably, the distal sections 202*x*, 204*x* defines a suitable length for welding (e.g., via resistive welding) the distal sections 202*x*, 204*x* to longitudinal wires 112 of the MSE. For example, the tensile strength of the assembly of the connector 200A and the longitudinal wires 112 should be roughly the same as that of the longitudinal wires 112 such that the weld is not a weakened. Although preferably the coupling of the connector 200A to the longitudinal wires 112 at the distal end of the connector 200A is achieved via welding, e.g., resistive welding in which metal is not added, other techniques including metal added welding techniques may alternatively or additionally be utilized. Preferably, distal sections 202*x*, 204*x* which are to be welded to the longitudinal wires 112 have a suitable length for welding them to the longitudinal wires 112 such that the strength of the weld is sufficient to resist tensile and/or shear forces that might be applied.

The wire which forms the connector 200A may be bent using a mandrel (not shown) and the receptacle 201, defining the opening 201*a*, at the proximal end may be formed by turning the wire a number a desired number of turns or degrees (e.g., 180 degrees or 540 degrees) such that the proximal end of the connector is coiled and defines a shape having an opening extending lengthwise through the coil. The opening 201*a* may be configured to accept a fastener, e.g., a bolt, when placed in an anchoring system at the wall face. Immediately after the bend the two wires continue and extend substantially horizontal to one another for a slight distance. The bottom horizontal wire is then deflected up while the top horizontal wire is deflected down so they deflect and continue in the same plane. The two wires are then deflected at an angle then are deflected back so they are parallel to the longitudinal wires of the soil reinforcing. The first deflected angel is a function of the distance the longitudinal wires are spaced from one another. The second deflection angle is a function of the angle required to bring them parallel with the longitudinal wires. By allowing the first deflection angle to vary the length of the connection wire can be limited keeping the cost of the connection uniform.

While the present disclosure may have been shown and described with reference to various embodiments thereof, it will be understood by those skilled in the art that various changes in form and details may be made therein without departing from the scope and spirit of the present disclosure as defined by the appended claims and their equivalents. In other words, the various exemplary embodiments disclosed in the present specification and drawings are merely specific embodiments to facilitate an understanding of the various aspects of the present disclosure and are not intended to limit the scope of the present disclosure. For example, the particular ordering of the steps may be modified or changed without departing from the scope and spirit of the present disclosure. Therefore, the scope of the present disclosure is defined not by the detailed description of the disclosure but by the appended claimed, and all differences in the scope should be construed as being included in the present disclosure.

What is claimed is:

1. Soil reinforcing elements for attachment to mechanically stabilized earth structures, comprising:

a plurality of reinforcing gridworks for attachment to anchors of the mechanically stabilized earth structures, each comprising a first wire extending in a longitudinal direction having a proximal end, and a second wire extending in the longitudinal direction having a proximal end spaced apart by a width orthogonal to the longitudinal direction, wherein the first and second wires of different reinforcing gridworks are spaced apart by different widths;

a plurality of connection elements, each comprising a single length of wire forming a first leg attached to the proximal end of the first wire, a fastener receptacle in unitary construction with the first leg, and second leg in unitary construction with the fastener receptacle attached to the proximal end of the second wire;

wherein each fastener receptacle comprises a bend about an axis orthogonal to the longitudinal direction forming a swivel comprising a loop of the single length of wire of at least 365 degrees for connection to the anchor;

wherein the first and second legs of each connector element are bendable to selectively align, abut and weld the connector element to the first and second wires of the different reinforcing gridworks spaced apart by different widths.

2. The soil reinforcing element of claim 1, wherein the first wire is substantially parallel to the second wire.

3. The soil reinforcing element of claim 1, further comprising a plurality of transverse wires connecting the first and second wires.

4. The soil reinforcing element of claim 1, wherein the single length of wire defines a cross-section that is round, square, rectangular, hexagonal, octagonal, or a combination thereof.

5. The soil reinforcing element of claim 1, wherein the swivel comprises a loop of the single length of wire of at least 540 degrees.

6. The soil reinforcing element of claim 1, wherein:

the first leg further comprises a first a section extending in the longitudinal direction to a distal end, and a second section extending orthogonally from the distal end; and the second leg further comprises a first section extending in the longitudinal direction to a distal end, and a second section extending orthogonally from the distal end.

7. A mechanically stabilized earth structure comprising:

a facing comprising a back face located adjacent to an earthen formation or backfill;

a plurality of anchors extending from the back face;

a plurality of soil reinforcing elements, each attached to a respective anchor and comprising:

a reinforcing gridwork extending into the earthen formation or backfill comprising a first wire extending in a longitudinal direction having a proximal end, and a second wire extending in the longitudinal direction having a proximal end spaced apart by a width orthogonal to the longitudinal direction, a connection element comprising a single length of wire forming a first leg attached to the proximal end of the first wire, a fastener receptacle in unitary construction with the first leg, and second leg in unitary construction with the fastener receptacle attached to the proximal end of the second wire, wherein the fastener receptacle comprises a bend about an axis orthogonal to the longitudinal direction forming a swivel comprising a loop of the single length of wire of at least 365 degrees connected to the anchor; and wherein the first and second wires of different reinforcing gridworks are spaced apart by different widths; and wherein the first and second legs of each connection element are bent to selectively align, abut and weld the connector element to the first and second wires of respective reinforcing gridworks spaced apart by different widths.

8. The mechanically stabilized earth structure of claim 7, wherein the first wire is substantially parallel to the second wire.

9. The mechanically stabilized earth structure of claim 7, further comprising a plurality of transverse wires connecting the first and second wires.

10. The mechanically stabilized earth structure of claim 7, wherein the single length of wire defines a cross-section that is round, square, rectangular, hexagonal, octagonal, or a combination thereof.

11. The mechanically stabilized earth structure of claim 7, wherein the swivel comprises a loop of the single length of wire of at least 540 degrees.

12. The mechanically stabilized earth structure of claim 7, wherein:

the first leg further comprises a first a section extending in the longitudinal direction to a distal end, and a second section extending orthogonally from the distal end; and the second leg further comprises a first section extending in the longitudinal direction to a distal end, and a second section extending orthogonally from the distal end.

13. A method for reinforcing mechanically stabilized earth structures, comprising:

providing a plurality of reinforcing gridworks, each comprising a first wire extending in a longitudinal direction having a proximal end, and a second wire extending in the longitudinal direction having a proximal end, the first and second wires spaced apart from each other by a width orthogonal to the longitudinal direction, wherein the first and second wires of different reinforcing gridworks are spaced apart by different widths;

providing a plurality of connection elements, each comprising a single length of wire forming a first leg, a fastener receptacle in unitary construction with the first leg comprising a loop of the single length of wire of at least 365 degrees, and second leg in unitary construction with the fastener receptacle;

for each of a plurality of selected connection elements:

bending one or both of the first and second legs of a selected coupling element to be spaced apart from each other by a displacement corresponding to the width of a selected gridwork to align and abut the connector element to the first and second wires;

resistive welding the first leg of the selected connection element to the first wire of the selected gridwork;

resistive welding the second leg of the selected connection element to the second wire of the selected gridwork;

coupling the fastener receptacle of the selected connection element to an anchor of a mechanically stabilized earth structure.

14. The method of claim 13, wherein the step of coupling the fastener receptacle to the anchor comprises bolting.

* * * * *